US009099796B2

(12) United States Patent
Myer et al.

(10) Patent No.: US 9,099,796 B2
(45) Date of Patent: Aug. 4, 2015

(54) RECEPTACLE CONTACT

(71) Applicant: TYCO ELECTRONICS CORPORATION, Berwyn, PA (US)

(72) Inventors: John Mark Myer, Millersville, PA (US); Hurley Chester Moll, Hershey, PA (US); Paul Eric Wittensoldner, Washington Boro, PA (US); Michael P. Witmer, Mount Joy, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/568,670

(22) Filed: Dec. 12, 2014

(65) Prior Publication Data

US 2015/0099408 A1 Apr. 9, 2015

Related U.S. Application Data

(63) Continuation-in-part of application No. 13/490,028, filed on Jun. 6, 2012, now Pat. No. 8,911,253.

(60) Provisional application No. 61/496,086, filed on Jun. 13, 2011.

(51) Int. Cl.

| | |
|---|---|
| ***H01R 4/48*** | (2006.01) |
| ***H01R 13/11*** | (2006.01) |
| ***H01R 13/187*** | (2006.01) |
| ***H01R 43/16*** | (2006.01) |

(52) U.S. Cl.

CPC ..... *H01R 4/4809* (2013.01); *H01R 13/113* (2013.01); *H01R 13/187* (2013.01); *H01R 43/16* (2013.01); *Y10T 29/49117* (2015.01)

(58) Field of Classification Search

CPC ..... H01R 13/15; H01R 13/113; H01R 13/16; H01R 13/187

See application file for complete search history.

(56) References Cited

U.S. PATENT DOCUMENTS

| | | | | |
|---|---|---|---|---|
| 5,158,485 | A | 10/1992 | Saito et al. | |
| 5,462,459 | A | 10/1995 | Childs | |
| 5,702,272 | A | 12/1997 | Machida | |
| 5,941,741 | A | 8/1999 | Dobbelaere et al. | |
| 6,062,918 | A | 5/2000 | Myer et al. | |
| 6,095,873 | A | 8/2000 | Muramatsu et al. | |
| 6,447,345 | B2 | 9/2002 | Sato et al. | |
| 6,524,142 | B2 | 2/2003 | Heimueller | |
| 6,524,143 | B2 * | 2/2003 | Chen | 439/852 |
| 6,547,608 | B2 | 4/2003 | Sato et al. | |
| 6,905,376 | B2 * | 6/2005 | Chen | 439/852 |
| 7,094,115 | B2 * | 8/2006 | Noro et al. | 439/852 |
| 7,140,927 | B2 * | 11/2006 | Casses et al. | 439/852 |
| 7,347,747 | B2 | 3/2008 | Shimizu | |

(Continued)

*Primary Examiner* — Jean F Duverne

(57) ABSTRACT

A receptacle contact includes a resilient contact arm having at least one contact area for contacting a mating contact. A support arm is stamped and formed from an area of a wall of the receptacle contact. The support arm cooperates with the resilient contact arm to support the resilient contact arm. An overstress member is provided on the wall of the receptacle contact. The overstress member is formed to extend into the area of the wall from which the support arm was formed. The overstress member cooperates with the support arm to prevent the support arm from being moved beyond the overstress member and beyond the area of the wall from which the support arm was formed, thereby ensuring that the resilient contact arm and the support arm will provide sufficient normal force to maintain a mechanical and electrical engagement with a mating contact.

20 Claims, 7 Drawing Sheets

(56) References Cited

U.S. PATENT DOCUMENTS

| | | | | |
|---|---|---|---|---|
| 7,553,203 | B2 | 6/2009 | Anbo et al. | |
| 8,021,200 | B2 | 9/2011 | Myer et al. | |
| 8,118,621 | B2 * | 2/2012 | Fukase | 439/852 |
| 8,827,756 | B2 * | 9/2014 | Mueller | 439/852 |
| 2010/0029146 | A1 | 2/2010 | Myer et al. | |

* cited by examiner

RECEPTACLE CONTACT

CROSS-REFERENCES TO RELATED APPLICATIONS

This application claims the priority of U.S. patent application Ser. No. 13/490,028 filed on Jun. 6, 2012, which claims priority from U.S. provisional patent application No. 61/496,086 filed Jun. 13, 2011, incorporated herein by reference in its entirety.

FIELD OF THE INVENTION

The invention relates to receptacle contacts, and more particularly to receptacle contacts with multiple contact areas with overstress members to prevent contact arms on which the contact areas are located from taking a permanent set.

BACKGROUND OF THE INVENTION

Currently electrical contacts or wire contacts are used to terminate a wire. Wire contacts require a strong mechanical means of attaching to the wire to create a permanent termination and a means to mate to a mating contact to form an electrical connection. For example, a wire contact may have a crimp end for terminating the wire and a male or female mating end for a mating contact. Some contacts have been developed from metal strips or pre-plated metal strips, which are stamped and then folded or formed into the appropriate shape. These contacts have a generally box shaped mating end for mating to a contact having a pin or blade type mating end. Contacts with a boxed shaped mating end have external size and shape requirements to fit into a cavity of a connector and an internal design for providing the mechanical and electrical connection means for receiving and holding the pin or blade contact of the mating contact. In current contacts having generally boxed shaped mating ends, a contact or compliant beam may be the means to receive and hold the mating pin contact.

However, known connectors typically contact and mate the pin or mating contact at up to two areas. This can result in a lack of sufficient physical contact that reduces the reliability of the electrical connection and renders the connector susceptible to reduction or loss of connection. Further, vibration or other motion or movement may result in a loss of connection.

In addition, some known connectors have contact beams that have a high spring force, which decreases the ability to control the normal force applied by the contact beam, increasing the mating force of the connector, and increasing tolerance sensitivity. Other connector problems may arise from having the contact beam exposed to the mating pin, leaving the contact beam unprotected from damage from external factors.

What is needed is a contact and method of insertion that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY OF THE INVENTION

An exemplary embodiment is directed to a receptacle contact for receipt of a mating contact therein. The receptacle contact has a contact portion with side walls, each of the side walls has an opening provide therein. A resilient contact arm extends between the side walls. The resilient contact arm has a fixed end and a distal end with at least one first contact area positioned proximate thereto. Projections extend from the resilient contact arm and extend through the openings of the side walls. A weak area is provided on the resilient contact arm, the weak area positioned between the fixed end and the projections. The weak area having a second contact area positioned proximate thereto. The projections engage a top wall of the opening of the sidewalls as the mating contact is inserted into the receptacle contact, causing the second contact area proximate the weak area to move into engagement with the mating contact, thereby providing multiple areas of contact between the resilient contact arm and the mating contact to provide a stable and reliable electrical connection therebetween.

An exemplary embodiment is directed to a receptacle contact for receipt of a mating contact therein. The receptacle contact has side walls, each of the side walls has an opening provide therein. A first resilient contact arm extends between the side walls. The first resilient contact arm has a fixed end and a free end with at least one first contact area positioned proximate to the free end. Projections extend from the first resilient contact arm, the projections extend through the openings of the side walls. A weak area is provided on the first resilient contact arm, the weak area positioned between the fixed end of the first resilient contact arm and the projections of the first resilient contact arm. The weak area having a second contact area positioned proximate thereto. A second resilient contact arm extends between the side walls. The second resilient contact arm has a fixed end and a free end. A third contact area is positioned proximate to the free end of the second resilient contact arm. The third contact area is positioned laterally between the at least one first contact area of the first resilient contact arm and the weak area of the first resilient contact arm. The projections engage a wall of the opening as the mating contact is inserted into the receptacle contact, causing the second contact area proximate the weak area to move into engagement with the mating contact, thereby providing multiple areas of contact between the first and second resilient contact arms and the mating contact to provide a stable and reliable electrical connection therebetween.

An exemplary method is directed to a method of inserting a mating contact into a receptacle contact, the receptacle contact having side walls and at least one resilient contact arm, the method comprising: engaging the at least one resilient contact arm with the mating contact; moving the at least one resilient contact arm from an unstressed position; engaging a wall of an opening with at least one projection of the at least one resilient contact arm to prevent further movement of a weak area of the at least one resilient contact arm; and moving a portion of the at least one resilient contact arm about the weak area of the at least one resilient contact arm after the at least one projection has engaged the wall of the opening.

An exemplary embodiment is directed to a receptacle contact for receipt of a mating contact therein. A contact portion of the receptacle contact includes a first resilient contact arm having a having a fixed end and a distal end with at least one first contact area for contacting a mating contact positioned on the resilient contact arm proximate the distal end. A support arm is stamped and formed from an area of a wall of the receptacle contact. The support arm cooperates with the first resilient contact arm to support the first resilient contact arm. An overstress member is provided on the wall of the receptacle contact. The overstress member is formed to extend into the area of the wall from which the support arm was formed. The overstress member cooperates with the support arm to prevent the support arm from being moved beyond the overstress member and beyond the area of the wall from which the support arm was formed, thereby ensuring that the first resilient contact arm and the support arm will provide sufficient normal force to maintain a mechanical and electrical engagement with the mating contact.

An exemplary embodiment is directed to a receptacle contact for receipt of a mating contact therein. A contact portion of the receptacle contact includes a first resilient contact arm which has a fixed end and a distal end with at least one first contact area for contacting a mating contact positioned on the first resilient contact arm proximate the distal end. A second resilient contact arm has at least one second contact area for contacting a mating contact position on the second resilient contact arm. A support arm is stamped and formed from an area of a wall of the receptacle contact. The support arm cooperates with the first resilient contact arm to support the first resilient contact arm. An overstress member is provided on the wall of the receptacle contact. The overstress member is formed to extend into the area of the wall from which the support arm was formed. The overstress member cooperates with the support arm to prevent the support arm from being moved beyond the overstress member and beyond the area of the wall from which the support arm was formed, thereby ensuring that the first resilient contact arm and the support arm will provide sufficient normal force to maintain a mechanical and electrical engagement with the mating contact.

An exemplary embodiment is directed to a receptacle contact for receipt of a mating contact therein. A contact portion of the receptacle contact includes a resilient contact arm having a having a fixed end and a distal end with at least one contact area for contacting a mating contact positioned on the resilient contact arm proximate the distal end. A support arm stamped and formed from an area of a wall of the receptacle contact. The support arm cooperates with the first resilient contact arm to support the resilient contact arm. An overstress member provided on the wall of the receptacle contact. A free end of the support arm is formed to extend beyond the area of the wall from which the support arm was formed. The overstress member cooperates with the support arm to prevent the support arm from being moved beyond the overstress member and beyond the area of the wall from which the support arm was formed, thereby ensuring that the resilient contact and the support arm will provide sufficient normal force to maintain a mechanical and electrical engagement with the mating contact.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, like reference numerals are used to refer to like elements throughout the application.

DETAILED DESCRIPTION OF THE INVENTION

In the following detailed description, numerous specific details are set forth in order to provide a thorough understanding of various embodiments. However, those skilled in the art will understand that the embodiments may be practiced without these specific details, that the embodiments are not limited to the depicted embodiments, and that the embodiments may be practiced in a variety of alternative embodiments. In other instances, well known methods, procedures, and components have not been described in detail.

Further, various operations may be described as multiple discrete steps performed in a manner that is helpful for understanding the embodiments. However, the order of description should not be construed as to imply that these operations need be performed in the order they are presented, or that they are even order-dependent. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated.

The disclosure relates to a receptacle contact and method of mechanically and electrically engaging a mating pin contact with the receptacle contact.

Figure 1:
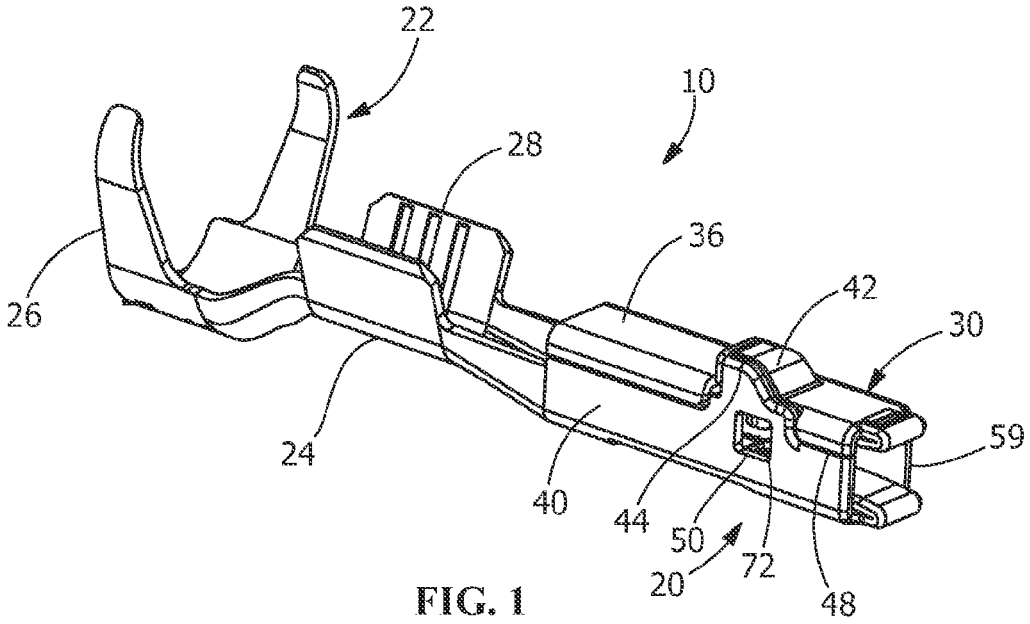
FIG. 1 is a perspective side view of an exemplary embodiment of the receptacle contact of the present invention.
Figure 2:
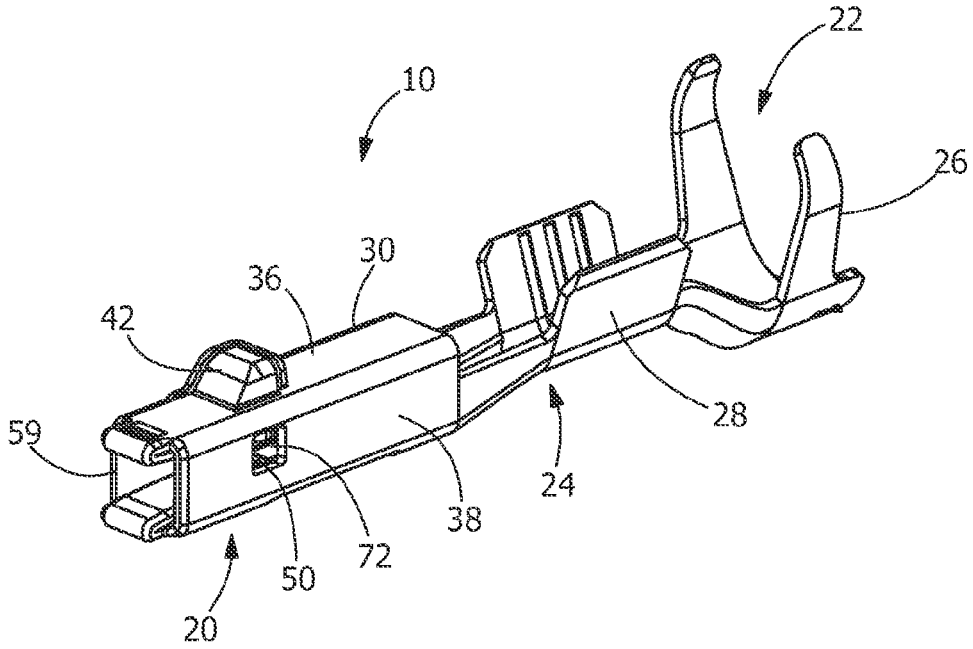
FIG. 2 is an alternate perspective side view of an exemplary embodiment of the receptacle contact of FIG. 1.

The exemplary embodiment of FIGS. 1 and 2 shows a perspective view of a receptacle contact 10 including a mating portion 20, a crimp portion 22 and a transition portion or region 24. The entire receptacle contact 10 is formed from a stamped sheet-metal form, which is stamped and formed or bent into the configuration shown in FIGS. 1 and 2.

In the exemplary embodiment shown, the crimp portion 22 has a rear insulation member 26 and a conductor member 28. The insulation member 26 and conductor member 28 respectively engage the insulation and the conductor of a wire in a known manner. While a crimped connection is shown, the portion 22 may connect to a respective wire using other known technology, such as, but not limited to, insulation displacement technology. The transition portion 24 extends between the mating portion 20 and the crimp portion 22.

Figure 4:
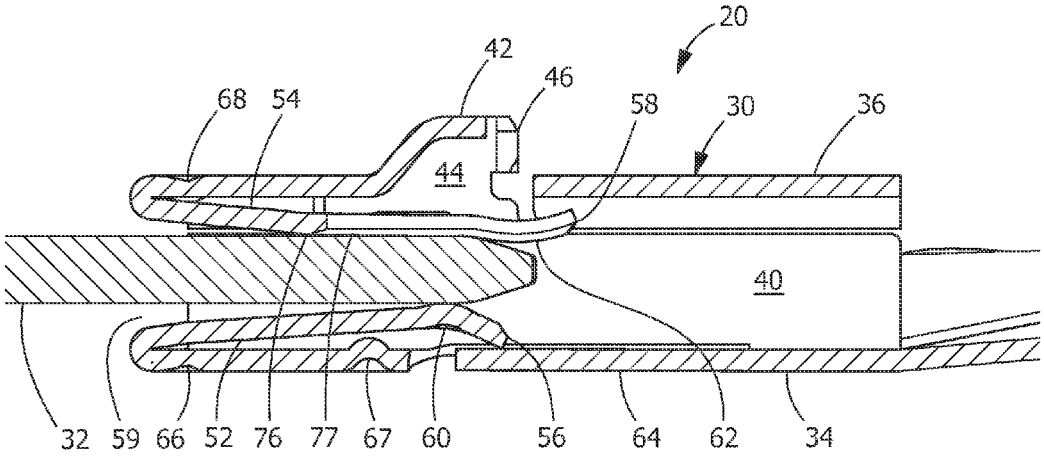
FIG. 4 is a partial longitudinal cross-section side view taken along the longitudinal center axis of the contact portion of the receptacle contact, similar to that of FIG. 3, with a mating pin shown in an intermediate mating position.
Figure 5:
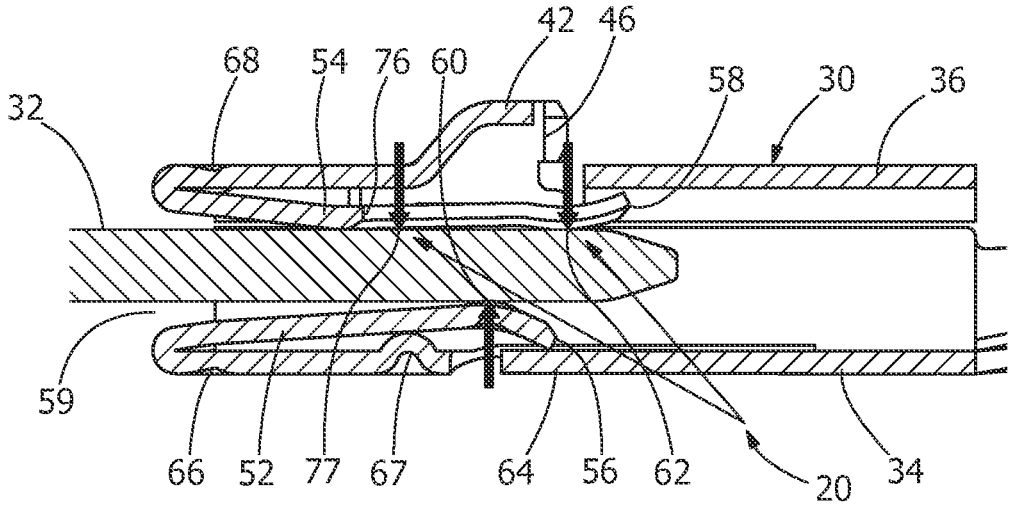
FIG. 5 is a partial longitudinal cross-section side view taken along the longitudinal center axis of the contact portion of the receptacle contact, similar to that of FIG. 3, with the mating pin fully inserted in the contact portion.

The mating portion 20 includes a box-shaped contact portion 30 for accepting a respective mating contact or mating pin contact 32 (FIGS. 4 and 5). The box-shaped contact portion 30 has a bottom wall 34, a top wall 36 and side walls 38, 40. As best shown in FIGS. 1 and 2, the top wall 36 has an orientation and/or locking feature or locking projection 42 which projects outward therefrom. The locking projection 42 is dimensioned to cooperate with a cavity of a housing (not shown) to maintain the receptacle contact 10 in position in the housing. The locking projection 42 cooperates with the housing to provide the primary retention of the receptacle contact 10 in the housing. The locking projection 42 also acts as a polarizing means. If a housing into which the receptacle contact 10 is to be inserted has a corresponding cavity into which the projection is to be positioned, then it is assured that the receptacle contact 10 cannot be improperly inserted into the housing.

Side wall 38 extends between and is integrally attached to the bottom wall 34 and the top wall 36. Side wall 40, as best shown in FIG. 1, extends from bottom wall 34 and is positioned proximate top wall 36. A portion 44 of side wall 40 is configured to approximate the shape of the locking projection 42, thereby providing a side surface for the locking projection 42 when the side wall 40 of the contact portion 30 is folded in position. A fold-over flap 46, as best shown in FIG. 5, extends from the portion 44 of the side wall 40 to provide additional strength to the locking projection 42 and to prevent unwanted material from entering the contact portion 30 through openings in the locking projection 42. As is shown in the figures, free end of side wall 40 and free end of top wall 36 are positioned proximate each other forming a seam 48.

Each side wall 38, 40 has an opening 50 which extends therethrough. In the exemplary embodiment shown, the openings 50 are proximately aligned with the locking projection 42; however other configurations may be used without departing from the scope of the invention.

Figure 3:
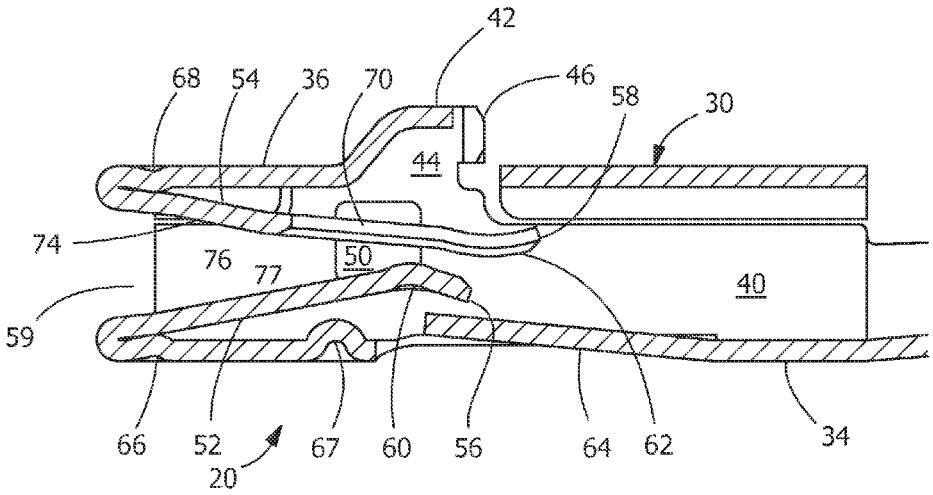
FIG. 3 is a partial longitudinal cross-section side view taken along the longitudinal center axis of a contact portion of the receptacle contact of FIG. 2.

With reference to FIGS. 3 through 5, the one-piece receptacle contact 10 has a first resilient contact arm or spring arm 52 and a second resilient contact arm or spring arm 54, which are formed integrally from the bottom wall 34 and the top wall 36, respectively. The resilient contact arms or spring arms 52, 54 extend between the side walls 38, 40. The resilient contact arms 52, 54 are each bent back from a fixed end 59 into the contact portion 30 by an angle of approximately 180 degrees. Portions of the two resilient contact arms 52, 54 extend toward one another. Free ends or distal ends 56, 58 of the resilient contact arms 52, 54 have respective freely movable contact areas 60, 62 provided proximate thereto. In the embodiment shown, the contact areas are rounded and are laterally offset, but are relatively close together, so that even when small contact pins are inserted, a secure and reliable mechanical and electrical connection is assured. In the exemplary embodiment shown in FIG. 3, the distal ends 56, 58, while offset, extend backward approximately halfway from the fixed end 59 of the contact portion 30 into the interior of the contact portion 30. However, other lengths of the resilient contact arms 52, 54 may be incorporated without departing from the scope of the invention, thereby allowing the contact areas to be positioned to accommodate mating contact pins 32 of different lengths. At least in the region of the contact areas 60, 62, the resilient contact arms 52, 54 are preferably provided with a plating or metalizing layer, such as a gold or tin overlay, thereby providing an enhanced electrical connection with the inserted contact pin.

Referring to FIG. 3, spring arm 52 has a support arm or backup spring 64 positioned proximate thereto. The support arm 64 is formed from the bottom wall 34. The support arm 64 is bent into the interior of the contact portion 30 and supports the spring arm 52 proximate the distal end 56 thereof when the spring arm 52 is moved downward as the mating contact pin 52 is inserted, as shown in FIG. 4. However, the support arm 64 may contact or engage the spring arm 52 at other locations depending upon the support desired. To assure that the spring arm 52 rests properly on the support arm 64, the support arm 64 may be chamfered on its forward end. The support arm 64 cooperates with the spring arm 52 to provide additional contact force as the mating contact 32 is inserted. The additional contact force supplied by the support arm 64 allows the spring arm 52 to apply a substantially higher contact force for the same spring travel.

As best shown in FIGS. 3 through 5, a support device or support device 66 may be provided on the bottom wall 34. The support device 66 is provided proximate to, but spaced from the 180 degree bend. The spring arm 52 cooperates with the support device 66 to allow the forces applied to the spring arm 52 during the insertion of the mating pin to be transferred through the support device 66 to the bottom wall 34. The shape and spacing of the support device 66 can be varied depending upon the structure of the spring arm 52 and the contact portion 30.

An overstress projection 67 may also be provided on the bottom wall 34. The overstress projection 67 is provided between the support device 66 and the distal end 56 of the spring arm 52. The overstress projection 67 is provided to cooperate with the spring arm 52 as the mating pin contact 32 is inserted into the receptacle contact 10. As the spring arm 52 is deflected toward the bottom wall 34, the overstress projection 67 may engage the spring arm 52 to prevent further movement of the spring arm 52 toward the bottom wall 34, thereby preventing the spring arm 52 from taking a permanent set. The position and size of the overstress protection 67 may be directly related to the amount of deflection required for the spring arm 52 to take a permanent set.

In one embodiment, the bottom wall 34 has a support arm 64 and no overstress projection 67. In another embodiment, the bottom wall 34 has an overstress projection 67 but no support arm 64. In another embodiment, the bottom wall 34 has both an overstress projection 67 and support arm 64.

A support device or detent 68 may be provided on the top wall 36. The support device 68 is provided proximate to, but spaced from the 180 degree bend of the spring arm 54. The spring arm 54 cooperates with the support device 68 to allow the forces applied to the spring arm 54 during the insertion of the mating pin to be transferred through the support device 68 to the top wall 36. No or essentially no force is generated by the 180 degree bend, thereby generating no stress in the 180 degree bend. The shape and spacing of the support device 68 can be varied depending upon the structure of the spring arm 54 and the contact portion 30.

Figure 6:
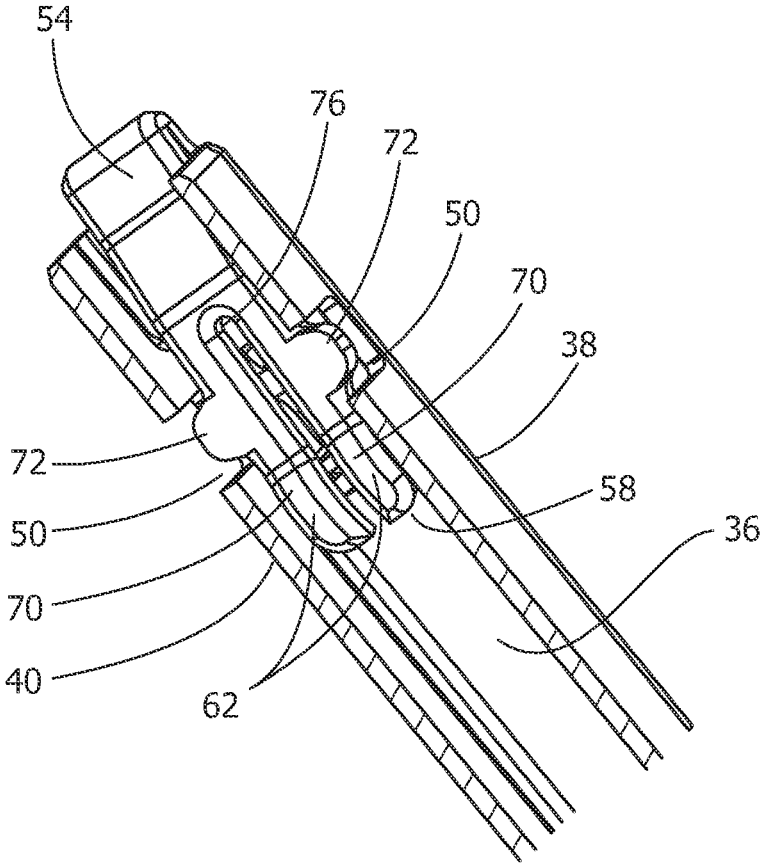
FIG. 6 is a partial cutaway view of the contact portion showing bifurcated beams of a respective spring arm.
Figure 7:
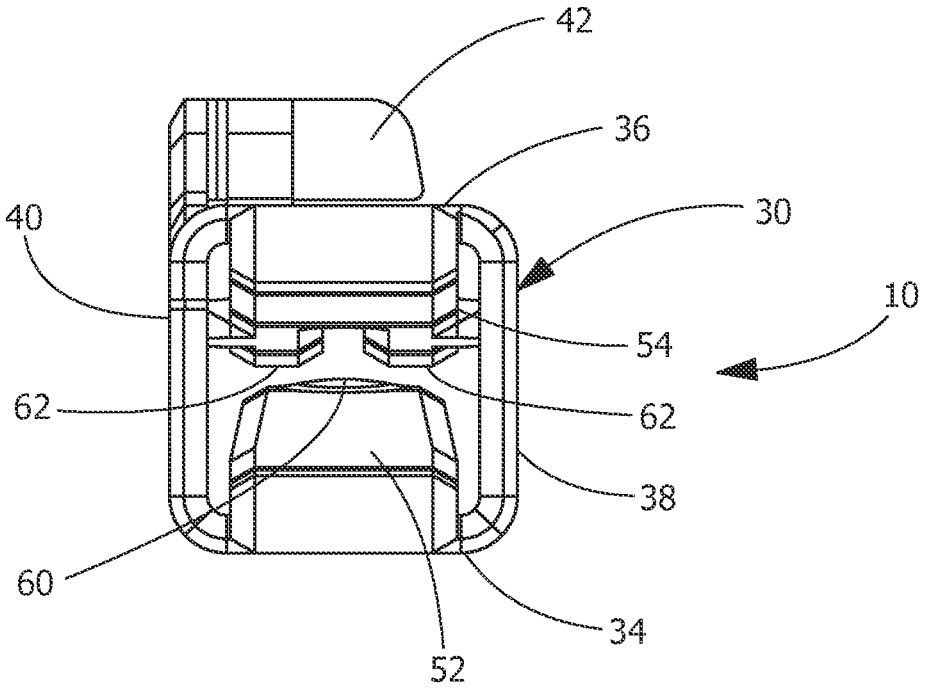
FIG. 7 is a front elevational view of the receptacle contact of FIG. 1.

As previously described, spring arm 54 has contact areas 62 provided proximate the distal end 58 thereof. In the embodiment shown, as best shown in FIGS. 6 and 7, the spring arm 54 has two bifurcated beams 70 proximate the distal end 58. Each bifurcated beams 70 extends from a weak area 76 to the distal end 58 and has a contact area 62 located thereon. Each beam 70 has a projection 72 which extends from the beam 70 into the opening 50 of the side walls 38, 40, as will be more fully described. A non-bifurcated cantilevered beam 74 is integrally attached to the bifurcated beams 70 at one end and to the 180 degree bend of the spring arm 54 at the other end. The interconnection between the non-bifurcated cantilevered beam 74 and the bifurcated beams 70 is configured to be a weak area 76 relative to the non-bifurcated beam cantilevered beam 74 thereby allowing the weak area 76 provided on the resilient contact arm 54 to act as a pivot area, allowing the bifurcated cantilever beams 70 to rotate about the weak area 76 and to move relative to the non-bifurcated beam cantilevered beam 74, as will be more fully described. The weak area 76 is provided on the resilient contact arm 54 and is positioned between the fixed end 59 and the projections 72. The bifurcated beams 70 are more easily displaced than the relatively stiff non-bifurcated beam cantilevered beam 74. A second contact area 77 is provided at or proximate to the weak area 76. As shown in FIG. 5, the contact area 77 is transversely offset relative to the contact area 62 along the path of insertion of the mating contact pin 32.

FIG. 3 illustrates the receptacle contact 10 prior to the insertion of the mating pin contact therein. In this position, the resilient contact arms 52, 54 are in an unstressed position. FIG. 4 illustrates the mating pin contact 32 in an intermediate mating position and FIG. 5 illustrate the mating pin contact 32 fully inserted into the contact portion 30 of the receptacle contact 10. Contact area 60 of resilient contact arm 52 is positioned laterally between the contact areas 62 of the resilient contact arm 54 and the contact area 77 of the resilient contact arm 54.

As is shown in FIG. 4, as the mating pin contact 32 is inserted into the contact portion 30, the mating pin contact 32 engages the contact area 60 of spring arm 52. The spring force generated by the spring arm 52 and the support arm 64 force the mating pin contact 32 into engagement with the contact areas 62 of the spring arm 54 as the insertion of the pin contact 32 continues, thereby positioning the pin contact 32 in electrical and mechanical engagement with the contact area 60 on spring arm 52 and the contact area 62 of the spring arm 54 simultaneously. Alternatively, if the mating pin contact 32 is inserted in an offset manner or if the mating pin contact 32 is bent, the mating pin contact 32 may engage the contact areas 62 of the spring arm 54 first. In this example, the spring force generated by the spring arm 54 forces the mating pin contact 32 into engagement with the contact area 60 of the spring arm 52 as the insertion of the pin contact 32 continues, thereby positioning the pin contact 32 in electrical and mechanical engagement with the contact areas 60, 62.

As the insertion of the pin contact 32 continues to the position shown in FIG. 5, the spring arm 54 is caused to move toward the top wall 36. As this occurs, the projections 72 of the bifurcated beams 70 of the spring arm 54 are moved into engagement with a top wall of the openings 50. This prevents the projections 72 and the contact areas 77 from further movement toward the top wall 36, causing the contact areas 77 to become or act as fixed contact areas. As insertion of the mating pin contact 32 continues, the spring force of the spring arm 52 and the support arm 64 continue to apply an upward force to the pin contact. As the contact areas 77 cannot move further, the application of this force causes the contact area 77 and the weak area 76 between the non-bifurcated cantilevered beam 74 and the bifurcated beams 70 to act as a pivot area. Consequently, as the insertion of the contact pin 32 continues, the contact areas 62 can move relative to the weak area 76 and contact areas 77, which are maintained in position by the projections 72. This continues until the area proximate the contact areas 77 and the contact areas 62 are all in electrical and mechanical engagement with a surface of the contact pin 32. The contact area 77 and the contact areas 62 provide at least three areas of contact between the spring arm 54 and the mating pin 32. In the embodiment shown, the weak area 76 and contact areas 77 are slightly offset, but in other embodiments the weak area 76 and contact areas 77 may overlap.

With the pin contact 32 engaged at both the contact areas 62 and contact areas 77, further movement of the spring arm 54 is limited. Therefore, any further displacement of the resilient contact arms 52, 54 required as the mating pin contact 32 is inserted is facilitated by the spring arm 52 and support arm 64.

During insertion of the mating pin contact 32, the mating pin contact 32 contacts the weak area 76 and the contact areas 77 of the spring arm 54, which provide a "lifting" or moving force. As the contact areas 77 are spaced from the fixed end of the spring arm 54 and the contact areas 62 are positioned proximate the distal end 58 of the spring arm 54, the normal force required to move the spring arm 54 is reduced. The mating force or the force required to deflect the spring arm 54 is a cubic function of the distance or length from the bend to the respective contact areas. As insertion continues and the lifting of the spring arm 54 is substantially complete, the contact areas 62 are contacted by mating pin contact 32. As the spring arm 54 almost fully deflected or "lifted" by the weak area 76 and contact areas 77, the contact areas 62 engage the mating pin contact 32 with a low mating force and a shallow mating angle, thereby allowing the contact areas 62 to be placed in electrical contact with the mating pin contact 32 with minimal wear on the contact areas 62 and the plating thereof.

In the fully inserted position, the contact areas 60, 62 and the contact areas 77 are all provided in electrical and mechanical contact with the mating pin contact 32. The multiple areas of contact allow the receptacle contact 10 to be used in applications in which higher current levels, such as, but not limited to, 15 to 20 or more amps are required.

As best shown in FIG. 5, the contact area 60, contact areas 77 and contact areas 62 are spaced laterally relative to each other, allowing the connection between the pin contact 32 and the receptacle contact 10 to be stable in environment in which high vibration may occur. In the inserted position, the contact areas 77 and contact areas 62 form a flat pad on which the mating contact 32 can rest, thereby insuring that the mating contact 32 will remain properly positioned as vibration occurs.

In addition, as the contact areas 77, contact area 60 and contact areas 62 are laterally offset from each other, the receptacle contact 10 provides multiple contact areas even if the mating pin contact 32 is bent, causing the pin contact 32 to not engage a particular area. In addition, the multiple contact areas resist twisting or misalignment of the mating pin contact 32.

In one embodiment, the resilient contact arms 52, 54 are configured such that all contact areas of the spring arm 54 generate an equal and opposite force to resist the force generated by spring arm 52. However, the configuration of the resilient contact arms 52, 54 and support arm 64 may be varied to allow the contact areas to have varied forces associated therewith. In particular, the positioning of the contact areas 60, 62 and the contact areas 77 can alter the force applied by each contact area.

As the contact areas 77 and contact areas 62 are transversely offset relative to the path of insertion of the mating pin contact 32, the plating wear on the mating pin contact 32 at any particular area is minimized, as the wear is distributed over different areas.

As is shown in the FIGS. 1 through 7, the one-piece receptacle contact 10 is formed to provide the contact portion 30. In many prior art contacts, box contacts are required to have additional material which is folded over the box to maintain the integrity of the box as forces associated with the insertion of the mating pin contact act to cause the box to be deformed to spread apart. Alternatively, prior art boxes have welded the seam together to maintain the integrity of the box contact. Each of these solutions is expensive as additional material is required and/or extra steps are required in the process of manufacture. In contrast, the cooperation of the projections 72 of the spring arm 54 with the openings 50 of the side walls 38, 40 perform the same function with no additional material needed and no additional manufacturing steps required. As the spring arm 54 is moved, as previously described, the projections 72 engage the wall of the opening 50. As this occurs, the force is transferred from the opening through the side walls 38, 40. No force is translated to the top wall 36. The forces in the side walls act along the transverse axis of the side walls. Consequently, no forces are transferred to the seam which act to separate or spread the seam. Therefore, the seam does not require any type of reinforcement, such as additional material or welding.

With reference to FIGS. 8 through 12, an alternate exemplary embodiment is shown. In this embodiment, the one-piece receptacle contact 110 has a first resilient contact arm or spring arm 152 and a second resilient contact arm or spring arm 154, which are formed integrally from the bottom wall 134 and the top wall 136, respectively. The resilient contact arms 152, 154 are each bent back from a fixed end 159 into the contact portion 130 by an angle of approximately 180 degrees. Portions of the two resilient contact arms 152, 154 extend toward one another. Free ends or distal ends 156, 158 of the resilient contact arms 152, 154 have respective freely movable contact areas 160, 162 provided proximate thereto. In the embodiment shown, the contact areas are rounded and are laterally offset, but are relatively close together, so that even when small contact pins are inserted, a secure and reliable mechanical and electrical connection is assured. In the exemplary embodiment shown in FIG. 8, the distal ends 156, 158, while offset, extend backward approximately halfway from the fixed end 159 of the contact portion 130 into the interior of the contact portion 130. However, other lengths of the resilient contact arms 152, 154 may be incorporated without departing from the scope of the invention, thereby allowing the contact areas to be positioned to accommodate mating contact pins 32 of different lengths. At least in the region of the contact areas 160, 162, the resilient contact arms 152, 154 are preferably provided with a plating or metalizing layer, such as a gold or tin overlay, thereby providing an enhanced electrical connection with the inserted contact pin. As the contact arm 154 is essentially identical to the contact arm 54, the detailed description thereof will not be repeated.

Figure 8:
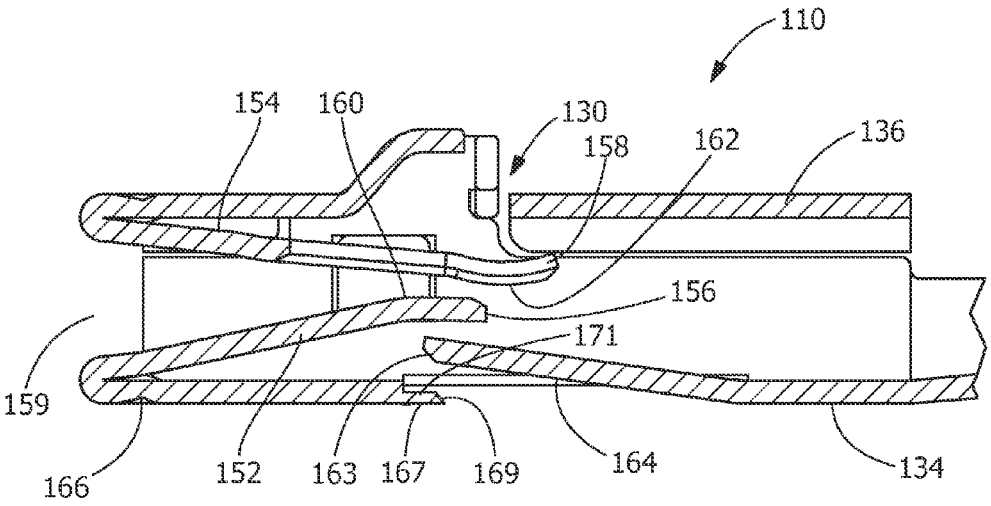
FIG. 8 is a partial longitudinal cross-section side view of an alternate embodiment of the receptacle contact taken along the longitudinal center axis of a contact portion of the receptacle contact.
Figure 12:
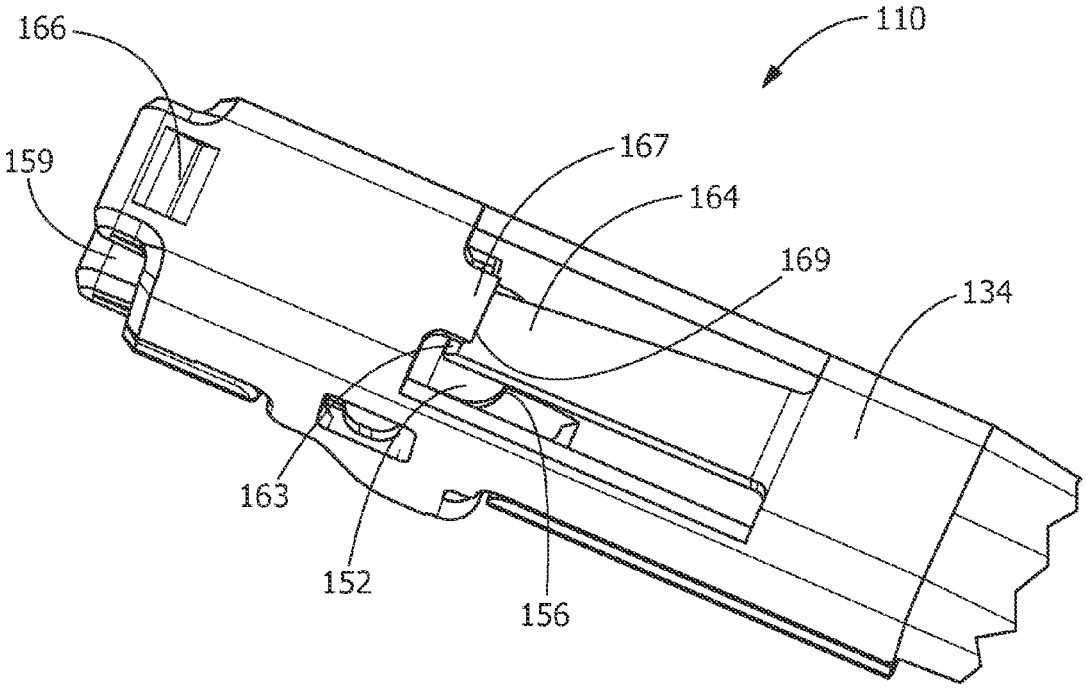
FIG. 12 is a bottom perspective side view of the alternate embodiment of the receptacle contact shown in FIG. 8.

Contact arm 152 has a resilient support arm or backup assist spring 164 positioned proximate thereto. The support arm 164 is formed from the bottom wall 134. The support arm 164 is stamped or sheared from the bottom wall 134. In the embodiment shown, the end 163 of the support arm 164 is sheared at approximately 50 degrees from the bottom wall 134, although other angles and configurations may be used without departing from the scope of the invention. After the support arm 164 is sheared, the support arm 164 is formed or bent into the interior of the contact portion 130, as best shown in FIGS. 8 and 12.

Either before or after the support arm 164 is formed or bent into the interior of the contact portion 130, an overstress member 167 is provided on the bottom wall 134 of the receptacle contact 110 and is formed or coined from the free end 169 of the bottom wall 134 proximate the free end 163 of the support arm 164. The material at the free end 169 of the bottom wall 134, which has an end surface which is also sheared at approximately 50 degrees from the support arm 164, is coined or stamped causing the free end 169 to be compacted or reduced in thickness as compared to the remaining portion of the bottom wall 134. The coining of the free end 169 forms a recess 171 in the bottom wall 134. The recess 171 extends from the interior cavity of the contact portion 130. In the embodiment shown, the free end 169 is coined to approximately half the thickness of the bottom wall 134. The coining of the free end 169 causes the free end 169 to elongated in a direction parallel to the longitudinal axis of the contact 110 causing the free end 169 to extend into the area or space from which the support arm 164 was formed. In so doing the free end 169 overlaps with the free end 163 of the support arm 164. With the free end 169 formed as described, the free end 169 forms the overstress member 167. As the elongated overstress member 167 and the free end 163 of the support arm 164 overlap, the support arm 164 is prevented from moving past the overstress member 167 and past the bottom wall 134. The coining of the overstress member 167 may also cause the angles of the free ends 163, 169 to be changed from 50 degrees to 45 degrees or other appropriate angle. This allows the free end 163 of the overstress member 167 to better move into recess 171.

Figure 9:
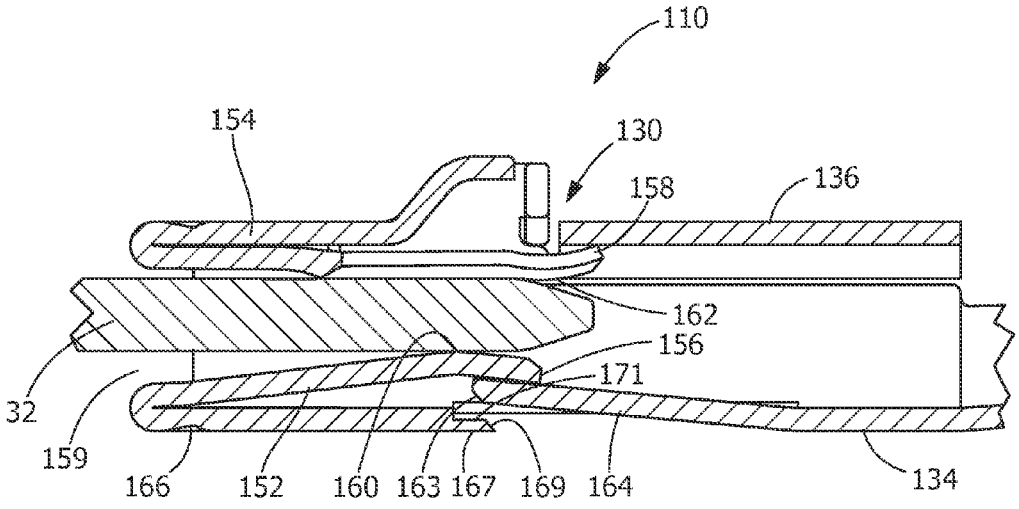
FIG. 9 is a partial longitudinal cross-section side view taken along the longitudinal center axis of the contact portion of the receptacle contact, similar to that of FIG. 8, with a mating pin shown in an intermediate mating position.

As previously stated the support arm 164 is formed or bent into the interior of the contact portion 130 and supports the contact arm 152 proximate the distal end 156 thereof when the contact arm 152 is moved downward as the mating contact pin 32 is inserted, as shown in FIG. 9. However, the support arm 164 may contact or engage the contact arm 152 at other locations depending upon the support desired. The support arm 164 cooperates with the contact arm 152 to provide additional contact force as the mating contact 32 is inserted. The additional contact force supplied by the support arm 164 allows the contact arm 152 to apply a substantially higher contact force for the same spring travel.

In alternative embodiments, the free end 163 of the support arm 164 may be coined or stamped causing the free end 163 to be compacted or reduced in thickness as compared to the remaining portion of the support arm 164. The coining of the free end 163 causes the free end 163 to elongated in a direction parallel to the longitudinal axis of the contact 110 causing the free end 163 to extend beyond the area or space from which the support arm 164 was formed. In so doing the free end 163 overlaps with the free end 169 of the overstress member 167.

In alternative embodiments, the sheared surfaces of the overstress member 167 and the support arm 164 may be coined such that the angles may be changed from 50 degrees to 45 degrees or other appropriate angle. The coining of the free end 163 and the free end 169 causes the free ends 163, 169 to elongated in a direction parallel to the longitudinal axis of the contact 110 causing the free ends 163, 169 to extend beyond the space from which they were formed. In so doing the free ends 163, 169 overlap each other.

Figure 10:
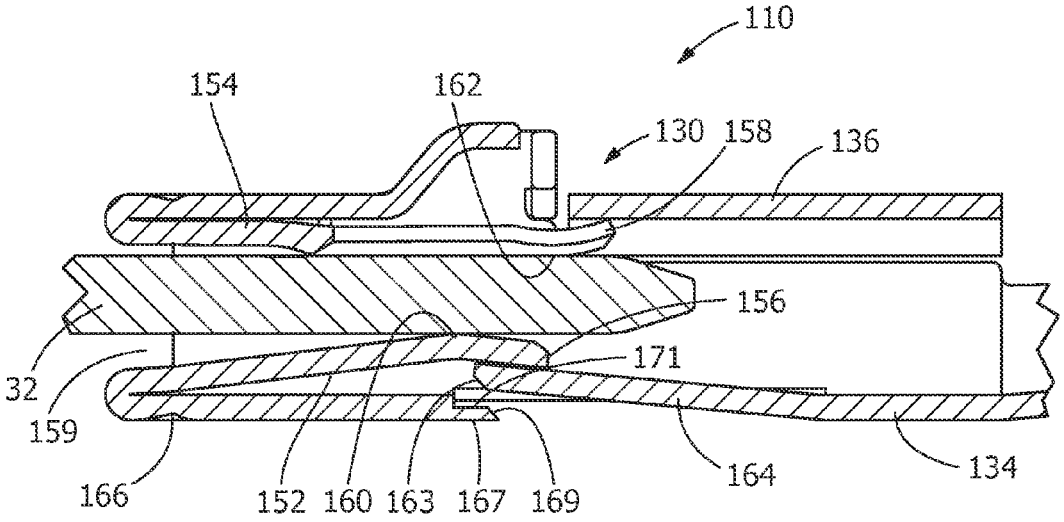
FIG. 10 is a partial longitudinal cross-section side view taken along the longitudinal center axis of the contact portion of the receptacle contact, similar to that of FIG. 8, with the mating pin fully inserted in the contact portion.

As best shown in FIGS. 8 through 10, a support detent or support device 166 may be provided on the bottom wall 134. The support device 166 is provided proximate to, but spaced from the 180 degree bend. The contact arm 152 cooperates with the support device 166 to allow the forces applied to the contact arm 152 during the insertion of the mating pin to be transferred through the support device 166 to the bottom wall 134. The shape and spacing of the support device 166 can be varied depending upon the structure of the contact arm 152 and the contact portion 130.

Figure 11:
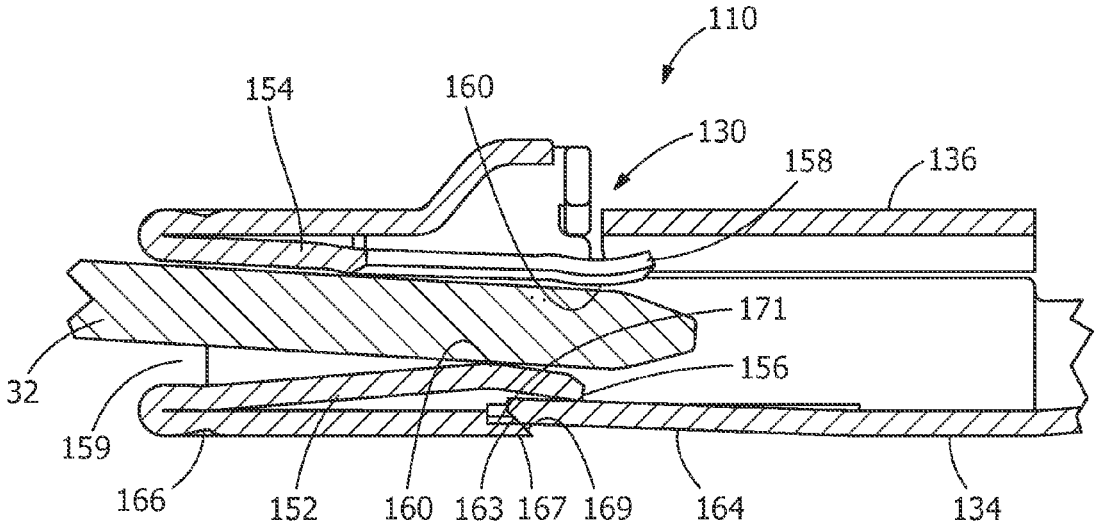
FIG. 11 is a partial longitudinal cross-section side view taken along the longitudinal center axis of the contact portion of the receptacle contact, similar to that of FIG. 8, with a mating pin shown in a skewed or wrenched intermediate mating position.

The overstress member 167 is provided between the support device 166 and the distal end 156 of the contact arm 152. The overstress member 167 is provided to cooperate with the support arm 164 as the mating pin contact 32 is inserted into the receptacle contact 110. As the contact arm 152 is deflected toward the bottom wall 134, the support arm 164 may engage the overstress member 167 to prevent the movement of the support arm 164 beyond the bottom wall 134, which in turn prevents the contact arm 152 from further movement toward the bottom wall 134. This prevents the resilient support arm 164 and the resilient contact arm 152 from taking a permanent set. As shown in FIG. 11, the support arm 164 is permitted to re-enter half way back into area from which it was sheared. In other words, the free end 163 of the support arm 164 can be moved to the position, as shown in FIG. 11, in which the angled surface of the free end 163 of the support arm 164 engages a top surface of the recess 171 of the overstress member 167. The engagement prevents further movement of the support arm 164 away from the contact portion 130, which in turn prevent further movement of the contact arm 152 away from the contact portion. This ensures that neither the contact arm 152 nor the support arm 164 will take a permanent set, thereby ensuring that the contact arm 152 and the support arm 164 will provide sufficient normal force to maintain a mechanical and electrical connection with the mating pin 32.

Overstress protection is important to ensure that a contact arm and a support arm maintain proper normal force with a mating pin even if accidental wrenching of the pin occurs during assembly or service. However, in low profile contacts or terminals, effective overstress protection can be difficult to provide due to the height limitations of the terminals and the forming constraints associated with the components of the terminals. The present invention overcomes these constraints as the contact arm, support arm and the overstress member are formed from the bottom wall of the contact. As one or more ends of the support arm or the overstress member are coined at their sheared ends, the newly angled or elongated surfaces of the support arm and the overstress member interact with each other to prevent the assist support arm from pushed beyond the overstress member and beyond the area from which the support arm was originally sheared, thereby providing overstress protection to the support arm and to the contact arm with which the support arm interacts.

The configuration of the resilient contact arms 52, 54, 152, 154 and the use of multiple contact areas allows for a lower normal force during mating and unmating of the mating contact pin 32 from the receptacle contact 10, 110. This allows the contact pin 32 and receptacle contact 10, 110 to be more durable over numerous cycles, as there is less plating wear due to the lower mating or normal forces. The number of contact areas also allows the receptacle contact 10, 110 to be used at higher current levels, as the number of contact areas allows the extreme heat associated with the high current levels to be dispersed, thereby preventing welding of the contact asperities. However, the newly angled or elongated surfaces also allow the free end 163 of the support arm 164 to be positioned in the recess 171 when the support arm 164 is stressed, allowing the support arm 164 to be returned to approximately its preformed position without taking a permanent set. This allows the receptacle 110 to have a low profile, as the profile of the receptacle 110 does not need to be increased to accommodate the proper functioning of the support arm 164.

While the above has been shown and described with respect to a mating pin contact, the invention is not so limited and may include any configuration of a mating electrical contact that is insertable into the receptacle contact 10, such as a tab, wire, plug or other electrical contact device.

While the written description has referred to a preferred embodiment, it will be understood by those skilled in the art that various changes and modifications may be made and equivalents may be substituted for elements thereof without departing from the patentable scope as defined by the claims. Therefore, it is intended that the patentable scope not be limited to the particular embodiments disclosed as the best mode contemplated, but rather other embodiments are intended to be within the scope of the claims if they have structural elements that do not differ from the literal language of the claims, or if they include equivalent structural elements with insubstantial differences from the literal language of the claims.

What is claimed is:

1. A receptacle contact for receipt of a mating contact therein, the receptacle contact having a contact portion comprising:

a first resilient contact arm having a having a fixed end and a distal end with at least one first contact area for contacting a mating contact positioned on the first resilient contact arm proximate the distal end;

a support arm stamped and formed from an area of a wall of the receptacle contact, the support arm cooperates with the first resilient contact arm to support the first resilient contact arm;

an overstress member provided on the wall of the receptacle contact, the overstress member being formed to extend into the area of the wall from which the support arm was formed;

wherein the overstress member cooperates with the support arm to prevent the support arm from being moved beyond the overstress member and beyond the area of the wall from which the support arm was formed, thereby ensuring that the first resilient contact arm and the support arm will provide sufficient normal force to maintain a mechanical and electrical engagement with the mating contact.

2. The receptacle contact as recited in claim 1, wherein the overstress member is coined or stamped to extend into the area of the wall from which the support arm was formed.

3. The receptacle contact as recited in claim 1, wherein the overstress member has a recess provided proximate a free end thereof, the recess extends from an interior cavity of the contact portion.

4. The receptacle contact as recited in claim 1, wherein the overstress member is elongated in a direction which is parallel to a longitudinal axis of the receptacle contact.

5. The receptacle contact as recited in claim 1, wherein an angled end surface of the overstress member and an angled end surface of the support member engage each other to prevent the support arm from being moved beyond the overstress member and beyond the area of the wall from which the support arm was formed.

6. The receptacle contact as recited in claim 1, wherein a free end of the support arm is formed to extend beyond the area of the wall from which the support arm was formed.

7. The receptacle contact as recited in claim 6, wherein the free end of the support arm is elongated in a direction which is parallel to a longitudinal axis of the receptacle contact.

8. A receptacle contact for receipt of a mating contact therein, the receptacle contact having a contact portion comprising:

a first resilient contact arm having a having a fixed end and a distal end with at least one first contact area for contacting a mating contact positioned on the first resilient contact arm proximate the distal end;

a second resilient contact arm having at least one second contact area for contacting a mating contact position on the second resilient contact arm;

a support arm stamped and formed from an area of a wall of the receptacle contact, the support arm cooperates with the first resilient contact arm to support the first resilient contact arm;

an overstress member provided on the wall of the receptacle contact, the overstress member being formed to extend into the area of the wall from which the support arm was formed;

wherein the overstress member cooperates with the support arm to prevent the support arm from being moved beyond the overstress member and beyond the area of the wall from which the support arm was formed, thereby ensuring that the first resilient contact arm and the support arm will provide sufficient normal force to maintain a mechanical and electrical engagement with the mating contact.

9. The receptacle contact as recited in claim 8, wherein the overstress member is coined to extend into the area of the wall from which the support arm was formed.

10. The receptacle contact as recited in claim 9, wherein the overstress member has a recess provided proximate a free end thereof, the recess extends from an interior cavity of the contact portion.

11. The receptacle contact as recited in claim 10, wherein the overstress member is elongated in a direction which is parallel to a longitudinal axis of the receptacle contact.

12. The receptacle contact as recited in claim 11, wherein an angled end surface of the overstress member and an angled end surface of the support member engage each other to prevent the support arm from being moved beyond the overstress member and beyond the area of the wall from which the support arm was formed.

13. The receptacle contact as recited in claim 8, wherein a free end of the support arm is formed to extend beyond the area of the wall from which the support arm was formed.

14. The receptacle contact as recited in claim 13, wherein the free end of the support arm is elongated in a direction which is parallel to a longitudinal axis of the receptacle contact.

15. A receptacle contact for receipt of a mating contact therein, the receptacle contact having a contact portion comprising:

a resilient contact arm having a having a fixed end and a distal end with at least one contact area for contacting a mating contact positioned on the resilient contact arm proximate the distal end;

a support arm stamped and formed from an area of a wall of the receptacle contact, the support arm cooperates with the resilient contact arm to support the resilient contact arm;

an overstress member provided on the wall of the receptacle contact;

a free end of the support arm formed to extend beyond the area of the wall from which the support arm was formed;

wherein the overstress member cooperates with the support arm to prevent the support arm from being moved beyond the overstress member and beyond the area of the wall from which the support arm was formed, thereby ensuring that the resilient contact arm and the support arm will provide sufficient normal force to maintain a mechanical and electrical engagement with the mating contact.

16. The receptacle contact as recited in claim 15, wherein the free end of the support arm is elongated in a direction which is parallel to a longitudinal axis of the receptacle contact.

17. The receptacle contact as recited in claim 16, the overstress member is elongated to extend into the area of the wall from which the support arm was formed.

18. The receptacle contact as recited in claim 17, the overstress member is coined to extend into the area of the wall from which the support arm was formed.

19. The receptacle contact as recited in claim 17, wherein the overstress member has a recess provided proximate a free end thereof, the recess extends from an interior cavity of the contact portion.

20. The receptacle contact as recited in claim 15, wherein an angled end surface of the overstress member and an angled end surface of the support member engage each other to prevent the support arm from being moved beyond the overstress member and beyond the area of the wall from which the support arm was formed.

* * * * *